US009512387B2

(12) United States Patent
Laser et al.

(10) Patent No.: US 9,512,387 B2
(45) Date of Patent: Dec. 6, 2016

(54) CLEANING COMPOSITIONS FOR REMOVING POLYMERIC CONTAMINANTS FROM PAPERMAKING SURFACES

(75) Inventors: Harold Laser, Hamilton, CA (US); Brandon E. Mahler, Cincinnati, OH (US); Robert E. Ebbeler, Cincinnati, OH (US)

(73) Assignee: DUBOIS CHEMICALS, INC., Sharonville, OH (US)

( * ) Notice: Subject to any disclaimer, the term of this patent is extended or adjusted under 35 U.S.C. 154(b) by 726 days.

(21) Appl. No.: 13/323,160

(22) Filed: Dec. 12, 2011

(65) Prior Publication Data

US 2012/0204916 A1 Aug. 16, 2012

Related U.S. Application Data

(60) Provisional application No. 61/441,870, filed on Feb. 11, 2011.

(51) Int. Cl.

| | |
|---|---|
| ***C11D 1/12*** | (2006.01) |
| ***C11D 1/66*** | (2006.01) |
| ***C11D 3/43*** | (2006.01) |
| ***C11D 3/44*** | (2006.01) |
| ***C11D 11/00*** | (2006.01) |
| ***C11D 3/30*** | (2006.01) |
| ***B08B 3/08*** | (2006.01) |
| *C11D 3/33* | (2006.01) |
| *C11D 1/72* | (2006.01) |
| *C11D 3/04* | (2006.01) |
| *C11D 3/20* | (2006.01) |
| *C11D 3/06* | (2006.01) |

(52) U.S. Cl.

CPC ..... *C11D 11/0041* (2013.01); *B08B 3/08* (2013.01); *C11D 1/66* (2013.01); *C11D 3/2037* (2013.01); *C11D 3/2062* (2013.01); *C11D 3/2093* (2013.01); *C11D 3/30* (2013.01); *C11D 3/43* (2013.01); *C11D 1/12* (2013.01); *C11D 1/72* (2013.01); *C11D 3/044* (2013.01); *C11D 3/046* (2013.01); *C11D 3/06* (2013.01); *C11D 3/2034* (2013.01); *C11D 3/33* (2013.01)

(58) Field of Classification Search

CPC ..... C11D 1/12; C11D 1/72; C11D 1/3044; C11D 3/046; C11D 3/06; C11D 3/2034; C11D 3/2037; C11D 3/2093; C11D 3/30; C11D 3/33

USPC ..... 510/101, 162, 166, 171, 188, 421, 426, 510/432, 499, 505, 506

See application file for complete search history.

(56) References Cited

U.S. PATENT DOCUMENTS

| | | | | |
|---|---|---|---|---|
| 4,886,575 | A | 12/1989 | Moreland | |
| 5,080,759 | A | 1/1992 | Buzby et al. | |
| 5,139,616 | A | 8/1992 | Ling | |
| 5,223,097 | A | 6/1993 | Hassler | |
| 5,863,385 | A | 1/1999 | Siebott et al. | |
| 5,916,857 | A | 6/1999 | Watson et al. | |
| 6,051,108 | A | 4/2000 | O'Neal, Jr. | |
| 6,060,439 | A * | 5/2000 | Doyel et al. | 510/164 |
| 6,172,031 | B1 | 1/2001 | Stevens | |
| 6,369,010 | B1 | 4/2002 | Dreisbach et al. | |
| 6,402,891 | B1 | 6/2002 | Asher et al. | |
| 6,890,405 | B1 | 5/2005 | Mah | |
| 7,288,511 | B2 * | 10/2007 | Doyel et al. | 510/412 |
| 8,440,598 | B2 * | 5/2013 | Sehgal et al. | 510/174 |
| 2003/0064910 | A1 * | 4/2003 | Fong et al. | 510/421 |
| 2003/0148911 | A1 * | 8/2003 | Smith et al. | 510/417 |
| 2003/0228996 | A1 * | 12/2003 | Hei et al. | 510/382 |
| 2004/0138077 | A1 * | 7/2004 | Pageau et al. | 510/201 |
| 2005/0096245 | A1 * | 5/2005 | Hei et al. | 510/383 |
| 2006/0234889 | A1 * | 10/2006 | Griese et al. | 510/214 |
| 2007/0087952 | A1 * | 4/2007 | Hei et al. | 510/214 |
| 2008/0087393 | A1 | 4/2008 | Pease et al. | |
| 2009/0099057 | A1 | 4/2009 | DeDominicis et al. | |
| 2009/0281012 | A1 | 11/2009 | Trivedi et al. | |

FOREIGN PATENT DOCUMENTS

| | | | |
|---|---|---|---|
| EP | 0178340 | A1 | 4/1986 |
| EP | 0 648 820 | A2 | 4/1995 |
| EP | 0 773 284 | A1 | 11/1997 |
| EP | 1 493 803 | B1 | 7/2006 |
| WO | 2009/137096 | A1 | 11/2009 |

OTHER PUBLICATIONS

Alfonic® Alcohol Ethoxylates from High Range Alcohols C12-C18; Technical Data Sheet; Sasol North America Inc.; Jan. 2003; pp. 1-3.

Rhodiasolv® IRIS; Rhodia; http://www.rhodia.com/en/binaries/novecare_rhodiasolv_iris_flyer_EN; Mar. 2008.

Hansen, C.; What are HSP?; www/hansen-solubility.com/index.php?; May 29, 2007; pp. 1-3.

Stach, S.; Using Hansen Space to Optimize Solvent Based Cleaning Processes for Manufacturing Electronic Assemblies; The Science of Cleaning; Jun. 18, 2009; pp. 1-9; Austin American Technology; Burnet, Texas.

Bio-Terge® PAS-8S; Products page; Stepan Company; p. 1; 2011.

Bio-Soft® S-101; Products page; Stepan Company; p. 1; 2011.

Isophorone Product Information; The Dow Chemical Company; Jun. 2002; pp. 1-2.

Proglyde DMM Product Information; The Dow Chemical Company; Mar. 2004; pp. 1-2.

(Continued)

*Primary Examiner* — Gregory R Delcotto

(74) *Attorney, Agent, or Firm* — Dinsmore & Shohl LLP

(57) ABSTRACT

Embodiments of cleaning compositions for removing polymeric soils comprise at least one surfactant, at least one amine, and a solvent blend comprising at least one aromatic alcohol, at least one dibasic ester, and at least one terpene solvent.

30 Claims, 1 Drawing Sheet

(56) References Cited

OTHER PUBLICATIONS

Dowanol DPnB Product Information; The Dow Chemical Company; Mar. 2004; pp. 1-3.
Dowanol TPnB Product Information; The Dow Chemical Company; Mar. 2004; pp. 1-2.
Tomadol® 25-12 Ethoxylated Alcohol; Product Information; Air Products and Chemicals, Inc. 1996-2011; p. 1.
Examiner's Report dated Nov. 1, 2013, relating to corresponding Canadian Patent Application No. 2,764,794.
Office Action pertaining to U.S. Appl. No. 14/613,799 dated Aug. 26, 2016.

* cited by examiner

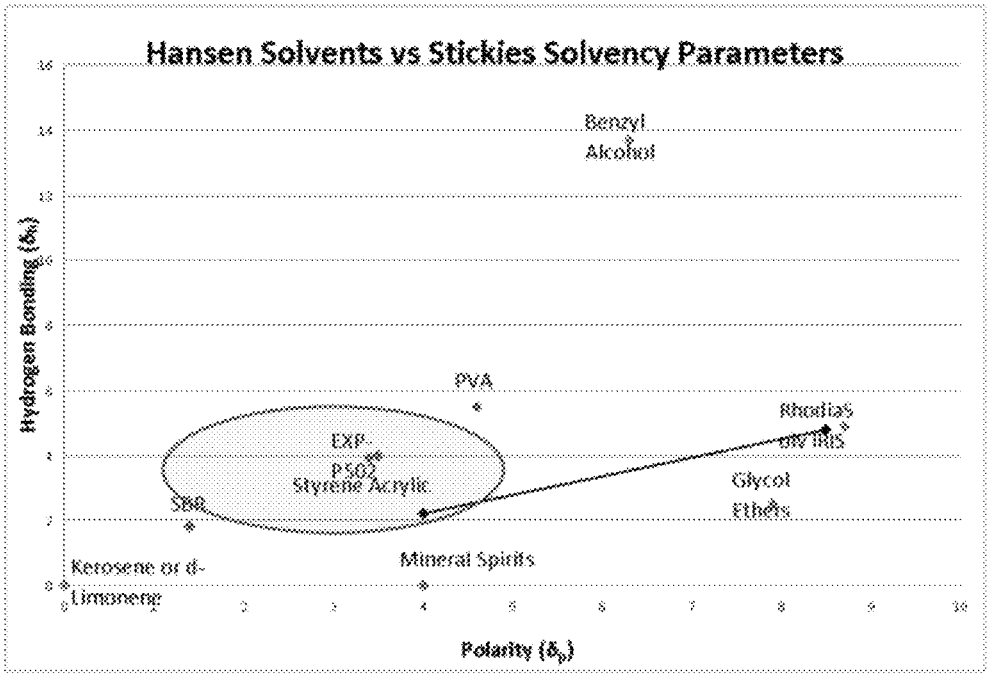
Hansen Solvents vs Stickies Solvency Parameters
Benzyl
Alcohol
PVA
Rhodias
UV IRIS
EXP
PSG
Styrene Acrylic
Glycol
Ethers
SBR
Mineral Spirits
Kerosene or d-
Limonene
Hydrogen Bonding ($\delta_H$)
Polarity ($\delta_p$)

CLEANING COMPOSITIONS FOR REMOVING POLYMERIC CONTAMINANTS FROM PAPERMAKING SURFACES

CROSS-REFERENCE TO RELATED APPLICATION

This application claims priority to U.S. Provisional Application Ser. No. 61/441,870 filed Feb. 11, 2011, which is incorporated by reference herein in its entirety

TECHNICAL FIELD

The present invention is generally directed to cleaning compositions or cleansers, and is specifically directed to cleaning compositions comprising solvent blends effective at solubilizing polymeric contaminants deposited on papermaking surfaces.

BACKGROUND

In the papermaking industry, more forms of paper are increasingly being made using recycled pulp. Much of the recycled pulp is post consumer paper from a wide variety of sources. As such, some portion of coatings, adhesives and inks make their way through the re-pulping process and lodge themselves on various critical machine surfaces as polymeric contaminants. These polymeric contaminants or soils will cause the paper web to stick to the surfaces of the paper web and cause imperfections in the product. These contaminants are often referred to as stickies and are especially difficult to remove since they are insoluble in paper making slurries and have a strong affinity for the surfaces of papermaking machines. Such imperfections must be culled from the paper and either discarded or sent through the re-pulping process again. This is a costly inefficiency in the papermaking process. Conventional solvents (e.g., hydrocarbon solvents such as kerosene) are ineffective at removing polymeric contaminants from machine surfaces, because these polymeric contaminants have high molecular weights and are only partially soluble in conventional solvents commonly used in the removal of natural contaminants (i.e., oils, resins, and pitch contaminants). Moreover, conventional solvents have proven to be ineffective at removing a broad range of polymeric soils, for example, polymeric soils yielded from recycled pulp. Accordingly, improved compositions effective at removing a broad range of polymeric soils are desirable.

SUMMARY

Embodiments of the present disclosure are directed to cleaning compositions that clean a wide range of polymer materials deposited on papermaking surfaces, without degrading the substrate surfaces.

According to one embodiment, a cleaning composition for removing polymeric soils is provided. The cleaning compositions comprises at least one surfactant, at least one amine, and a solvent blend comprising at least one aromatic alcohol, at least one dibasic ester, and at least one terpene solvent.

According to yet another embodiment, a method of removing polymeric soils from papermaking surfaces is provided. The method comprises developing a solvent blend that is a solubility match for the polymeric soils as defined by minimized Hansen Solubility Factor for all polymeric soils. The method further comprises producing an aqueous cleanser comprising the solvent blend, and applying the aqueous cleanser to papermaking surfaces such that the aqueous cleanser solubilizes and removes the polymeric soils from papermaking surfaces.

These and additional objects and advantages provided by the embodiments of the present invention will be more fully understood in view of the following detailed description, in conjunction with the drawing.

BRIEF DESCRIPTION OF THE DRAWINGS

The following detailed description of specific embodiments of the present invention can be best understood when read in conjunction with the drawings enclosed herewith.

FIG. 1 is a graphical illustration showing the solubility matching of the present solvent blend with the polymeric soils in accordance with one or more embodiments of the present disclosure.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION

Embodiments of the present disclosure are directed to cleaning compositions operable to soften and dissolve synthetic polymeric soils and remove them from various papermaking surfaces. Specifically, the components of the solvent blend in the present cleaning composition are selected to remove a broad range of synthetic polymer soils, especially the polymeric soils produced from recycled pulp used in the papermaking process. For example, the present cleaning compositions are targeted at deposited latexes, pressure sensitive adhesives, hot melts and coating additives such as polyvinyl alcohol/acetate, styrene butadiene rubber, styrene acrylic, ethylene vinyl alcohol/acetate and polyacrylic acid. Without being bound by theory, the present cleanser demonstrates significantly better cleaning efficiency with styrene acrylic and PVA soils as compared to conventional cleansers.

According to one embodiment, the cleaning composition for removing polymeric soils comprises at least one surfactant, at least one amine, and a solvent blend comprising at least one aromatic alcohol, at least one dibasic ester, and at least one terpene solvent.

The amine may comprise various suitable compositions effective for stabilizing the cleaning composition. For example and not by way of limitation, the amine comprises monoisopropanolamine, ethylenediamine, diethylenetriamine, triethylenetetramine, propylenediamine, aminoethyl aminoethanol, ethanolamine, diethanolamine, triethanolamine, diisopropanolamine, or combinations thereof. In one exemplary embodiment, the cleaning composition may comprise monoisopropanolamine. The cleaning composition may comprise from about 0.01 to about 5 weight % of the amine, or from about 1.5 to about 2.5 weight % of the amine.

The surfactant may comprise various compositions suitable for removing the deposited polymeric soils from an industrial surface, for example, nonionic surfactants, anionic surfactants, cationic surfactants, zwitterionic surfactants, or combinations thereof. In one embodiment, the surfactant may comprise a nonionic surfactant. For example, and not by way of limitation, the surfactant may comprise dodecylbenzene sulfonate, sodium-1-octane sulfonate, sodium caprylyl sulfonate, alcohol ethoxylates, or mixtures thereof. In one or more embodiments, the cleaning composition may comprises from about 1 to about 20 weight % of the surfactant, or from about 6 to about 18 weight % of the surfactant.

Without being bound by theory, the component ratios of the solvents in the solvent blend correlates with the ability of the cleaning composition to solubilize a broad range of deposited polymeric soils. In one exemplary embodiment, the solvent blend may comprise a ratio of aromatic alcohol to dibasic ester to terpene solvent equal to about 2:2:1. In alternative embodiments, the solvent blend may comprise a ratio of aromatic alcohol:dibasic ester of from about 0.7:1 to about 1:0.7, and a ratio of aromatic alcohol:terpene solvent of from about 1.5:1 to about 2.5:1. In yet another embodiment, the solvent blend may comprise a ratio of dibasic ester:terpene solvent of from about 1.5:1 to about 2.5:1. All ratios are based on weight percentages.

As used herein, the "solvent blend" does not include water in its definition, although many embodiments of the cleaning composition are aqueous compositions which include the solvent blend and water. For example, the cleaning composition may comprise up to about 90% by weight of water, or about 10 to about 80% water, or about 50 to about 80% by weight water. Depending on the amount of dilution of the composition, the cleaning composition may comprise about 10 to about 40 weight percent of the solvent blend. The solvent blend may comprise about 35 to about 45% by weight dibasic ester, about 35 to about 45% by weight aromatic alcohol, and about 15 to about 25% by weight terpene solvent.

Various terpene solvents are contemplated for the present invention. For example and not by way of limitation, the terpene solvent may comprise d-limonene, 1-limonene, dipentene, myrcene, alpha-pinene, linalool, orange oil, pine oil, 3-methoxy-3-methyl-1-butanol or mixtures thereof. In one exemplary embodiment, the terpene solvent is d-limonene. In one or more embodiments, the cleaning composition may comprise from about 1% to about 20% by weight of terpene solvent, or from about 2 to about 10% by weight terpene solvent, depending the amount of dilution of the cleaning composition.

Similarly, the dibasic ester may comprise various compositions, for example, dialkyl adipate, dialkyl methylglutarate and dialkyl ethylsuccinate, wherein the alkyl groups individually comprise a $C_1$-$C_{12}$ hydrocarbon group. In one embodiment, the dibasic ester is dimethyl-2 methyl glutarate. A suitable commercial embodiment of the dimethyl-2 methyl glutarate is the Rhodiasolv Iris® produced by Rhodia. In one or more embodiments, the cleaning composition may comprise from about 2% to about 40% by weight of dibasic ester, or from about 5 to about 15% by weight dibasic ester, depending the amount of dilution of the cleaning composition.

Various aromatic alcohols are also contemplated as suitable for the present cleaning compositions. As used herein, "aromatic alcohols" are alkyl aromatic alcohols, or any compositions with at least one phenyl group and an alcohol functional group optionally attached to the phenyl ring. For example and not by way of limitation, the aromatic alcohol may comprise aromatic alcohol is benzyl alcohol, phenoxyethanol, 1-phenoxy-2-propanol, furfural alcohol or combinations thereof. In one exemplary embodiment, the aromatic alcohol is benzyl alcohol. In one or more embodiments, the cleaning composition may comprise from about 2% to about 40% by weight of aromatic alcohol, or from about 5 to about 15% by weight aromatic alcohol, depending the amount of dilution of the cleaning composition.

The broad range efficacy of the solvent blend of the cleaning composition can be effectively demonstrated and quantified by Hansen Solubility Factor calculations. The Hansen Solubility Factor is a methodology that analyzes solvents or solvent blends based on their ability to solubilize soils or contaminants in those solvents. Stickies materials (i.e. synthetic polymeric soils) tend to have hydrogen bonding and polar properties higher than the natural contaminants (i.e., oils, resins, and pitch contaminants) found naturally in papermaking slurries. Thus, the solvent blends of the present composition include properties that closely match these hydrogen bonding and polar properties, as well as other factors such as molecular weight, solubility in water, toxicity and health and safety, etc. By using the Hansen Solubility Factor calculations, the present inventors were able to determine the best solvents for solubilizing the stickies, and surprisingly found certain blends of solvents have an unexpected synergy in removing a broad range of stickies from surfaces. In one embodiment, the present solvent blend yields a solubility match with a minimized Hansen Solubility Factors for all polymeric soils. In specific embodiments, the solubility match may be demonstrated when all targeted polymeric soils have a Hansen factor of below about 4 in the solvent blend.

As shown below in Table 1, the Hansen Solubility Factor was obtained for 3 polymeric soils in an exemplary solvent blend using the following equation:

$$HSF=\sqrt{(\delta_{d1}-\delta_{d2})^2+(\delta_{p1}-\delta_{p2})^2+(\delta_{h1}-\delta_{h2})^2}$$

wherein $\delta_{d1}$ is the energy from nonpolar, atomic (dispersion) interactions between polymeric soil molecules, $\delta_{d2}$ is the energy from nonpolar, atomic (dispersion) interactions between solvent molecules, $\delta_{p1}$ is the energy from permanent dipole-permanent dipole molecular interactions between polymeric soils, $\delta_{p2}$ is the energy from permanent dipole-permanent dipole molecular interactions between solvent, $\delta_{h1}$ is the energy from hydrogen bonding (electron interchange) molecular interactions for polymeric soils, and $\delta_{h2}$ is the energy from hydrogen bonding (electron interchange) molecular interactions for solvent.

Referring to table 1 below, the energy values for the dispersion, polarity, and hydrogen bonding variables of the polymeric soils and the solvents were obtained using reference tables. As shown in Table 1, the parameters are calculated for the exemplary solvent blend by utilizing 40%/40%/20% weight ratio for the Benzyl Alcohol/Rhodiasolv Iris/d-limonene values. After the parameters are obtained for the exemplary solvent blend and selected polymeric soils PVA, SBR, and Styrene Acrylate, the Hanson Solubility Factor may be calculated as shown in Table 2.

TABLE 1

| Stickies Polymers | Dispersion ($\delta_{d1}$) | Polarity ($\delta_{p1}$) | Hydrogen Bonding ($\delta_{h1}$) |
|---|---|---|---|
| PVA | 10.20 | 5.50 | 4.70 |
| SBR | 8.60 | 1.70 | 1.30 |
| Styrene Acrylate | 9.88 | 0.73 | 1.56 |
| **Individual Solvent** | **Dispersion ($\delta_{d2}$)** | **Polarity ($\delta_{p2}$)** | **Hydrogen Bonding ($\delta_{h2}$)** |
| Benzyl Alcohol | 9.00 | 3.10 | 6.70 |
| Rhodiasolv Iris | 8.12 | 4.25 | 2.44 |
| d-limonene | 8.00 | 0.10 | 0.10 |
| **Solvent Blend** | **Dispersion ($\delta_{d2}$)** | **Polarity ($\delta_{p2}$)** | **Hydrogen Bonding ($\delta_{h2}$)** |
| Benzyl Alcohol (40%) Rhodiasolv Iris (40%) d-limonene (20%) | 8.45 | 2.96 | 3.68 |

TABLE 2

| | Dispersion $(\delta_{d1}-\delta_{d2})^2$ $(\delta_{d1}-8.45)^2$ | Polarity $(\delta_{p1}-\delta_{p2})^2$ $(\delta_{p1}-2.96)^2$ | Hydrogen Bonding $(\delta_{h1}-\delta_{h2})^2$ $(\delta_{h1}-3.68)^2$ | Hansen Solubility Factor HSF= $\sqrt{(\delta_{d1}-\delta_{d2})^2+(\delta_{p1}-\delta_{p})^2+(\delta_{h1}-\delta_{h2})^2}$ |
|---|---|---|---|---|
| PVA Match with Solvent Blend | 3.08 | 6.45 | 1.04 | 3.25 |
| SBR Match with Solvent Blend | 0.02 | 1.59 | 5.65 | 2.70 |
| Styrene Acrylate Match with Solvent Blend | 2.04 | 4.96 | 4.47 | 3.39 |

As shown above in Table 2, the exemplary solvent blend yields Hansen Solubility Factors of below 4 for all polymeric soils, thereby demonstrating a solubility match for a broad range of polymer contaminants.

Referring now to FIG. 1, the specific mixture of the Rhodiasolv Iris, d-limonene, and benzyl alcohol as listed in Tables 1 was most effective at removing the polymeric soils of Table 1, because the solvent blend is substantially in the same zone as the soils. This solvent zone is illustrated by the elliptical area adjacent or surrounding the three above soils. This combination of materials was found to provide a broad range of polymer softening and solubility, and is unique in that any individual or combination of two solvents without the third solvent is not as effective. For comparison, a solvent blend with just d-limonene and IRIS would not have the broad range of soil removal, as illustrated by the black line on the chart of FIG. 1.

Table 3, which is provided below, lists exemplary cleansers in accordance with the present disclosure. Aqueous cleaning compositions may be beneficial because they can be easily introduced into a dilute water solution, in a range of 5 to 20% by volume, for spray and or recirculation cleaning.

TABLE 3

| | Concentrated non-aqueous formulation | Aqueous Cleanser (slightly acidic pH 5.5) | Diluted aqueous cleanser (neutral) |
|---|---|---|---|
| Deionized Water | 0 | 56.2 | 76.7 |
| Benzyl Alcohol | 37 | 10 | 5 |
| Rhodiasolv Iris | 37 | 10 | 5 |
| d-limonene | 18 | 5 | 2.5 |
| Bio-Terge ® PAS-8S (Sodium Caprylyl Sulfonate) | 0 | 8.5 | 4.2 |
| Biosoft S-101 (Dodecyl Benzene Sulphonic Acid) | 0 | 8.2 | 5.1 |
| Monoisopropanolamine | 0 | 2.1 | 1.5 |
| Tomadol 91-6 (nonionic alcohol ethoxylate surfactant) | 8 | 0 | 0 |

In operation, the cleaning composition is applied to papermaking surfaces such that the aqueous cleanser solubilizes and removes the polymeric soils from papermaking surfaces. As used herein, "papermaking surfaces" may define any suitable industrial surface, specifically any industrial surface prone to stickies deposition. For example, and not by way of limitation, these papermaking surfaces may metallic surfaces, alloy surfaces, ceramic surfaces, polymeric surfaces, tissues, nonwovens, machine fabrics, clothing, press felts, tad fabrics, forming wires, conveying belts, shoe presses, or any other suitable industrial surface familiar to one or ordinary skill in the art. The cleaning compositions may be applied to papermaking surfaces via spraying, soaking, foaming, foam recirculation or any other suitable delivery means. In one or more embodiments, the aqueous cleanser may be applied to papermaking surfaces at temperatures up to about 100° C., room temperature, or about 50 to about 55° C. The present inventors have determined that cleaning efficiency is enhanced when the cleaning solution temperature is at about 50 to about 55° C., which is close to the glass transition temperature of the polymeric soils. The cleaning composition is effective at various pH values, but is primarily used at a neutral pH value (7) or a value near the neutral pH value.

Alternatively, the present cleaning composition may also used in a combination cleanser with other cleansers such as alkaline cleaners. Whereas various basic compounds are contemplated for the alkaline cleanser, the alkaline cleanser may comprise one or more components selected from the group consisting of potassium hydroxide, sodium hydroxide, sodium hypochlorite, peroxides, triethanolamine (TEA), ethylenediaminetetraacetic acid (EDTA), nitrilotriacetic acid (NTA), sodium silicate, tetrasodium pyrophosphate (TSPP), sodium tripolyphosphate (STPP), 1-(2,5-dimethoxy-4-methylphenyl)propan-2-amine (STP) or combinations thereof. Additionally, the combination cleanser may include builders, surfactants and/or other formulation components. The combination cleanser may comprise a pH of about 10 to about 13.8. When utilized in a mixture with an alkaline cleanser in a basic pH range, the present inventors recognized that improved cleaning may be achieved.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A cleaning composition for removing polymeric soils comprising:

at least one surfactant;

at least one amine; and a solvent blend comprising at least one aromatic alcohol, at least one dibasic ester, and at least one terpene solvent.

2. The composition of claim 1 wherein the amine comprises monoisopropanolamine.

3. The composition of claim 1 wherein the cleaning composition comprises from about 0.01 to about 5 weight % of the amine.

4. The composition of claim 1 wherein the cleaning composition comprises from about 1.5 to about 2.5 weight % of the amine.

5. The composition of claim 1 wherein the surfactant is a nonionic surfactant.

6. The composition of claim 1 wherein the at least one surfactant is selected from the group consisting of dodecylbenzene sulfonate, sodium-1-octane sulfonate, sodium caprylyl sulfonate, alcohol ethoxylates, and mixtures thereof.

7. The composition of claim 1 wherein the cleaning composition comprises from about 1 to about 20 weight % of the surfactant.

8. The composition of claim 1 wherein the cleaning composition comprises from about 6 to about 18 weight % of the surfactant.

9. The composition of claim 1 wherein the solvent blend comprises a weight ratio of aromatic alcohol:dibasic ester: terpene solvent, wherein the ratio is 2:2:1.

10. The composition of claim 1 wherein the solvent blend comprises a weight ratio of aromatic alcohol:dibasic ester of from about 0.7:1 to about 1:0.7.

11. The composition of claim 1 wherein the solvent blend comprises a weight ratio of aromatic alcohol:terpene solvent of from about 1.5:1 to about 2.5:1.

12. The composition of claim 1 wherein the solvent blend comprises a weight ratio of dibasic ester:terpene solvent of from about 1.5:1 to about 2.5:1.

13. The composition of claim 1 wherein the cleaning composition comprises about 10 to about 40 weight percent of the solvent blend.

14. The composition of claim 1 wherein the solvent blend comprises about 35 to about 45% by weight dibasic ester, about 35 to about 45% by weight aromatic alcohol, and about 15 to about 25% by weight terpene solvent.

15. The composition of claim 1 wherein the terpene solvent is d-limonene.

16. The composition of claim 1 wherein the dibasic ester is selected from the group consisting of dialkyl adipate, dialkyl methylglutarate and dialkyl ethylsuccinate, wherein the alkyl groups individually comprise a $C_1$-$C_{12}$ hydrocarbon group.

17. The composition of claim 1 wherein the dibasic ester is dimethyl-2 methyl glutarate.

18. The composition of claim 1 wherein the aromatic alcohol is an alkyl aromatic alcohol.

19. The composition of claim 1 wherein the aromatic alcohol is benzyl alcohol.

20. A combination cleanser comprising:

the cleaning composition of claim 1; and a second alkaline cleanser.

21. The combination cleanser of claim 20 wherein the combination cleanser comprises a pH of about 10 to about 13.8.

22. A combination cleanser according to claim 20 further comprising one or more components selected from the group consisting of potassium hydroxide, sodium hydroxide, sodium hypochlorite, peroxides, triethanolamine, ethylenediaminetetraacetic acid, nitrilotriacetic acid, sodium silicate, tetrasodium pyrophosphate, sodium tripolyphosphate, 1-(2, 5-dimethoxy-4-methylphenyl)propan-2-amine, and combinations thereof.

23. A combination cleanser according to claim 20 further comprising builders, surfactants and/or other formulation components.

24. A cleaning composition for removing polymeric soils comprising:

at least one surfactant;

at least one amine; and a solvent blend having a Hansen Solubility Factor for polymeric soils of below 4.

25. The cleaning composition of claim 24 wherein the solvent blend comprises an aromatic alcohol.

26. The cleaning composition of claim 24 wherein the solvent blend comprises dibasic ester.

27. The cleaning composition of claim 24 wherein the solvent blend comprises terpene solvent.

28. A combination cleanser comprising:

the cleaning composition of claim 24; and a second alkaline cleanser.

29. The cleaning composition of claim 1 wherein the solvent blend has a Hansen Solubility Factor for polymeric soils of below 4.

30. The cleaning composition of claim 24 wherein the solvent blend comprises about 35 to about 45% by weight dibasic ester, about 35 to about 45% by weight aromatic alcohol, and about 15 to about 25% by weight terpene solvent.

* * * * *